United States Patent [19]

Ingram

[11] 4,101,898

[45] Jul. 18, 1978

[54] BASE FED, TOP-LOADED VERTICAL WHIP ANTENNA

[76] Inventor: David Lee Ingram, E. 7316 Boone, Spokane, Wash. 99206

[21] Appl. No.: 709,007

[22] Filed: Jul. 26, 1976

[51] Int. Cl.[2] ..... H01Q 9/16

[52] U.S. Cl. ..... 343/752; 343/895; 343/715

[58] Field of Search ..... 343/895, 752, 750, 749, 343/715, 714, 713, 712, 711

[56] References Cited

U.S. PATENT DOCUMENTS

| | | | |
|---|---|---|---|
| 1,314,095 | 8/1919 | Reuthe | 343/750 |
| 2,966,679 | 12/1960 | Harris | 343/895 |
| 3,259,901 | 7/1966 | Bykerk | 343/749 |

*Primary Examiner*—Alfred E. Smith

*Assistant Examiner*—David K. Moore

*Attorney, Agent, or Firm*—Wells, St. John & Roberts

[57] ABSTRACT

A top-loaded, helically-wound vertical antenna is described having an upright non-conductive core with a conductive element extending from a base upward alongside the core terminating in a closed, tightly-wound loading coil at the top of the core. The loading coil has a main upper coil segment and a lower small coil section which are separated a desired distance so that they are electromagnetically and electrically connected in series but sufficiently spaced to prevent temporary overloading. Electrically isolated booster coils are mounted about the conductive elements at desired locations of the lead section in which the booster coils are not electrically connected to the conductive element or to each other for boosting the reception of r-f energy.

6 Claims, 4 Drawing Figures

BASE FED, TOP-LOADED VERTICAL WHIP ANTENNA

BACKGROUND OF THE INVENTION

This invention relates to antennas for citizen band operation and more particularly to top-loaded, helically-wound vertical antennas for citizen band transmitters and receivers.

The antenna structure of this invention is adapted to mobile transmitter-receiver installations such as would be utilized for land or water mobile vehicles. In installations of this type, the antennas of prior art constructions generally comprise a single, electrically conductive element that is fed at one end and is effective as both a receiver and radiator of electromagnetic wave energy in a radio frequency spectrum. Such antennas have a physical construction to accommodate the mechanical force that may be applied to the antenna by the movement of the vehicle. Such antennas are generally constructed of metallic tubing having an electrical length equal to a quarter-wave in length of the desired communication frequency. These range in physical length from about nine feet for 27 mc to about 6 inches for 470 mc. The antennas are vertically mounted and supported at the bottom where they are end-fed.

It is well known that an electrical quarter-wave antenna may be physically shortened and still be effective as the desired wave length of adding inductances in series.

One of the major problems encountered in the construction of top-loaded, helically-wound citizen band antennas is that the operator will temporarily apply considerably greater energy to the antenna than is recommended. Citizen band antennas are generally designed to accommodate a 5 watt transmitter-receiver. Consequently the top-loaded coil is frequently burned out because of the temporary overloading. Frequently the very end of the antenna will produce a corona effect which ionizes the air around the very top end of the antenna causing damage to the antenna. Additionally, it has been found that such top-loaded antennas are particularly sensitive to atmospheric static.

One of the principal objects of this invention is to provide a simple top-loaded, helically-wound vertical antenna for citizen band operation that is a very efficient antenna and is capable of withstanding temporary overloading.

An additional object of this invention is to provide a top-loaded, helically-wound vertical antenna that reduces the static received at the designed frequency.

A further object of this invention is to provide a top-loaded, helically-wound, vertical antenna that has an extended distance range of communication over other prior antennas.

An additional object of this invention is to provide a top-loaded, helically-wound, vertical antenna for citizen band operation that has an increased reception distance range.

These and other objects and advantages of this invention will become apparent upon reading the following detailed description of a preferred embodiment.

BRIEF DESCRIPTION OF THE DRAWINGS

A preferred embodiment of this invention is illustrated in the accompanying drawings, in which.

DETAILED DESCRIPTION OF A PREFERRED EMBODIMENT

Figure 1:
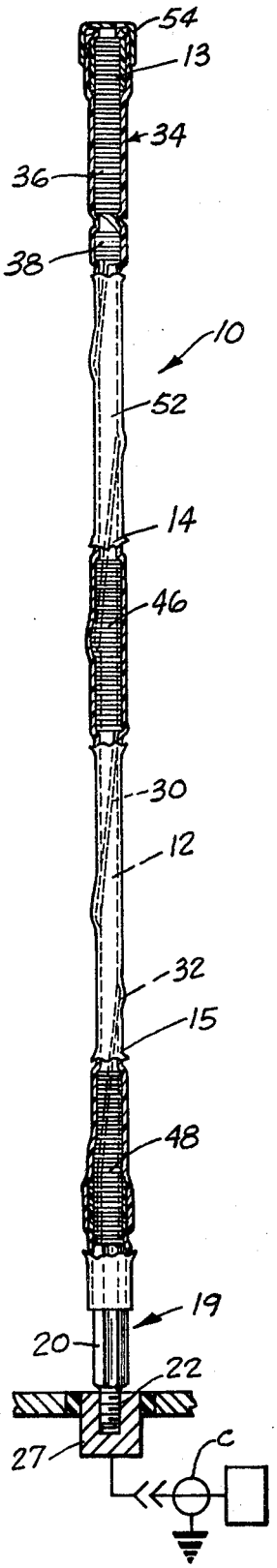
FIG. 1 is an elevational view, partially in section, of a top-loaded, helically-wound, antenna structure for citizen band operation embodying this invention.

Referring in detail to the drawings, there is illustrated in FIG. 1 a top-loaded, helically-wound vertical antenna generally designated with the numeral 10. The antenna is designed for 11 meter citizen band operation within the 25–30 mc band having a designed mid-range resonant frequency of approximately 27 mc.

The vertical antenna includes an elongated core 12 that extends from a lower or base portion 15 upward having a central portion 14 and an upper end portion 13. The core 12 is preferably made of a tubular or solid cylindrical section of fiberglass rod. The core 12 may be of uniform diameter throughout its length or it may have a slight taper depending upon the design criteria.

Figure 3:
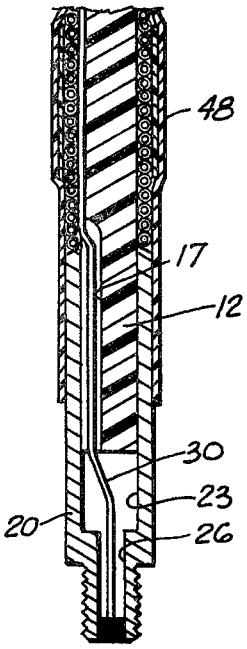
FIG. 3 is a fragmentary vertical cross-sectional view of the antenna illustrating in more detail a lower portion of the antenna.

The lower portion 15 has a slot or passageway 17 (FIG. 3) formed therein to accommodate a lead wire. The core 12 is supported on a mounting fixture 19 that may be attached to a mobile vehicle.

The mounting fixture 19 includes a mounting ferrule 20 having a threaded reduced end 22 for threadably mounting to the mobile vehicle and electrically connecting to a transmission line such as a coaxial cable. The mounting furrule 20 has a socket 23 formed therein to receive the lower end of the core 12. The furrule has an aperture 26 extending through the reduced threaded end 22 for accommodating the lead wire. The mounting fixture 19 may be supported on various types of antenna support mounts 27 of conventional design, with the threaded end 22 threaded into the antenna mount to support the antenna thereon. The antenna mount 27 includes termination of a transmission line that generally has an impedence value of approximately 52 ohms.

The antenna 10 further includes an electrically conductive element 30 preferably a copper wire having a dielectric coating thereon that extends from the mounting fixture 19 to the top of the upper end portion 13 of the core.

Figure 2:
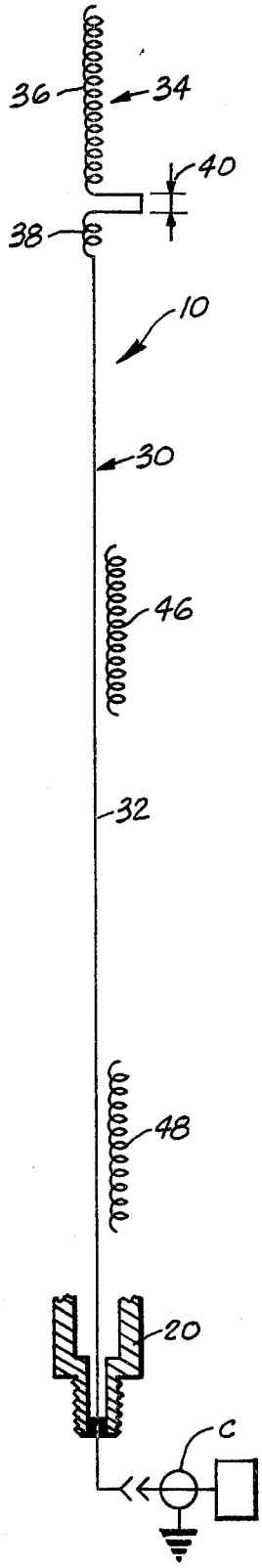
FIG. 2 is a diagrammatical illustration of the electrical equivalent circuit of the antenna structure of FIG. 1.

The electrically conductive element 30 includes a lead section 32 that extends from the mounting fixture 19 along the lower portion 15 and the center portion 14 terminating in a closed, tightly-wound helical coil section 34 at the upper end portion 13. The lead section 32 may extend straight along the lower portion 15 and central portion 14 or it may be wound about the lower portion and center portion of the core up to the upper end portion 13 having a very large pitch so that there is no mutual inductance transmitted between the turns of the lead section 32 between the mounting fixture 19 and the loading coil section 34. The purpose for the wrapping of lead section 32 about the core is to hold the lead section 32 securely to the exterior of the core during the construction process. However, electrically the lead section is intended to be a straight section as illustrated in FIG. 2 having little or no inductive or capacitive effect or influence. Preferably the copper wire is 18 or 20 gauge with HAPTZ dielectric coating (heavy armored poly-thermaleze).

The loading coil section 34 is composed of an upper main coil component 36 and a lower secondary coil component 38 that is spaced from and electrically connected in series with the upper main coil component 36 by a desired distance identified by the numeral 40. The secondary coil component 38 is sufficiently close to the component 36 to develop mutual inductance therebetween. The main coil component 36 has a vast majority of the closed wound coil turns. In a preferred embodiment the lower secondary coil component 38 has approximately 10 closed wound coil turns. The coil section 34 is formed in a tightly-wound single layer except for the space or distance 40. In a preferred embodiment the distance 40 should be between 0.187 inches and 0.313 inches.

The applicant has found that when the loading coil section 34 is constructed with a lower secondary coil component 38 spaced from the upper main coil component yet sufficiently close to be electromagnetically coupled with the main coil component, the main coil component 36 is protected from temporary overloading.

Additionally, the applicant has found that during reception, the space 40 causes the spaced secondary coil 38 to serve as a filter to remove static. He has also found that this construction increases the power efficiency of the antenna and substantially increases the range of reception and transmission of the antenna as opposed to those antennas that have a single helical coil section without the space 40.

Figure 4:
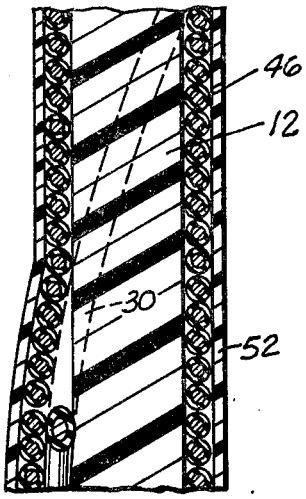
FIG. 4 is a vertical cross-sectional view of a central section of the antenna showing the relationship of an electrically isolated booster coil mounted about the antenna core.

The vertical antenna 10 further includes a first or central electrically isolated booster coil 46 that is wrapped around the center portion 14 of the coil and about the lead section 32 as illustrated in FIGS. 1, 2, and 4. The coil 46 is preferably formed of the same wire material as element 30. It is important that the isolated coil 46 be mounted in direct intimate contact with the lead section 32. The coil 46 is electromagnetically connected to the lead section to induce radio frequency energy into the lead wire during reception. The isolated booster coil 46 is preferably a closed tightly-wound helical coil having a single layer of turns.

The vertical antenna 10 further includes a second or lower electrically isolated booster coil 48 wound about the lower portion 15 of the core 12 and the lead section 32. Preferably the lower booster coil 48 is a closed tightly-wound coil formed in a single layer about the lead section 32. The turns of the coil 48 are in intimate contact with the lead section 32 and only separated by the insulation on the lead section. Preferably the coil 48 is constructed of the same wire material that forms element 30. The lower booster coil 48 is electrically isolated from the electrically conductive element 30 and the center isolated coil 46. Additionally, the coil 48 is electromagnetically isolated or separated from the central isolated coil 46 so that there is no significant mutual induction between the two. The lower booster coil 48 is electromagnetically coupled to the lead section 32 for inducing received radio frequency energy from the coil 48 into the lead section 32 during reception. Preferably the coils 46 and 48 have substantially the same number of turns.

The applicant has found that the addition of the electrically isolated booster coils 46 and 48 improve the range of reception of the antenna.

The entire antenna is covered and protected by a weather-tight protective envelope that is constructed of insulative material. Preferably the envelope 52 is constructed of a tubular plastic material that has been heat shrunk onto the core to provide a water-tight envelope over the antenna and the electrical elements. An insulative cap 54 is mounted on the top core 12 as further protection and to minimize the formation of a "corona effect".

The above described embodiments are simply illustrative of the principles of this invention, and numerous other embodiments may be readily devised by those skilled in the art without deviating therefrom. Therefore, only the following claims are intended to define this invention.

What is claimed is:

1. A base fed, top-loaded vertical whip antenna which is adapted to be connected to a radio frequency transmission line, comprising:

a vertical, elongated electrically non-conductive support core extending from a base end portion to an upper end portion with an intermediate central portion;

means for mounting the base end of the support core to a support with the upper end portion being freely unsupported;

an elongated electrically conductive wire having a dielectric coating thereon;

said electrically conductive wire having a lead section for operatively connecting to the radio frequency transmission line at the base end portion and extending from the base end portion along the central portion of the core to the upper portion of the core terminating in a closed, tightly-wound helical loading coil section wrapped about the upper end portion of the core;

said closed wound helical coil section having an upper main coil component with a majority of the closed, wound coil turns and a lower secondary coil component having a minority of the closed wound coil turns;

said secondary coil component being spaced immediately vertically below the main coil component a distance of between 0.187 and 0.313 inches with the secondary coil segment being electrically connected in series with the lead section and the main coil component and electromagnetically coupled to the main coil component.

2. The antenna as defined in claim 1 further comprising:

an electrically isolated central booster coil mounted about the lead section and the central portion of the core with the isolated booster coil intimately engaging the lead section to be electromagnetically coupled to the lead section to induce atmospheric radio frequency energy into the lead section;

said isolated central booster coil being sufficiently spaced from the helical loading coil section to prevent inductance therebetween.

3. The antenna as defined in claim 2 further comprising:

an electrically isolated lower booster coil mounted about the lead section and the base portion of the core with the isolated lower booster coil intimately engaging the lead section and electromagnetically coupled to the lead section to induce atmospheric radio frequency energy into the lead section;

said isolated lower booster coil being sufficiently spaced from the central booster coil to prevent mutual inductance therebetween.

4. A base fed, top-loaded vertical whip antenna which is adapted to be connected to a radio frequency transmission line, comprising:

a vertical, elongated electrically non-conductive support core extending from a base end portion to an upper end portion with an intermediate central portion;

means for mounting the base end of the support core to a support with the upper end portion being freely unsupported;

an elongated electrically conductive wire having a dielectric coating thereon;

said electrically conductive wire having a lead section extending from the base end portion along the central portion of the core to the upper portion of the core terminating in a closed, tightly-wound helical loading coil section wrapped about the upper end portion of the core;

an electrically isolated central booster coil mounted about the lead section and the central portion of the core with the isolated center booster coil intimately engaging the lead section to be electromagnetically coupled to the lead section to induce atmospheric radio frequency energy into the lead section;

an electrically isolated lower booster coil mounted about the lead section and the base portion of the core with the isolated lower booster coil intimately engaging the lead section and electromagnetically coupled to the lead section to induce atmospheric radio frequency energy into the lead section;

said isolated center and lower booster coils being sufficiently spaced from each other and the helical loading coil to prevent mutual inductance therebetween.

5. The antenna as defined in claim 4 wherein said closed wound helical coil section has an upper main coil component with a majority of the closed, wound coil turns and a lower secondary coil component having a minority of the closed wound coil turns;

said secondary coil component being spaced immediately vertically below the main coil component a desired distance with the secondary coil segment being electrically connected in series with the lead section and the main coil component and electromagnetically coupled to the main coil component.

6. The antenna as defined in claim 5 wherein the desired distance between the secondary coil segment and the main coil segment is between 0.187 inches and 0.313 inches.

* * * * *